US009709266B2

(12) United States Patent
Aldrich

(10) Patent No.: US 9,709,266 B2
(45) Date of Patent: Jul. 18, 2017

(54) COMBUSTOR FOR DISCRETE LOW AND HIGH PRESSURE VAPOUR COMBUSTION

(71) Applicant: Chris Aldrich, Sundre, CA (US)

(72) Inventor: Chris Aldrich, Sundre, CA (US)

( * ) Notice: Subject to any disclaimer, the term of this patent is extended or adjusted under 35 U.S.C. 154(b) by 168 days.

(21) Appl. No.: 14/304,351

(22) Filed: Jun. 13, 2014

(65) Prior Publication Data

US 2014/0370448 A1 Dec. 18, 2014

Related U.S. Application Data

(60) Provisional application No. 61/834,841, filed on Jun. 13, 2013, provisional application No. 61/866,645, filed on Aug. 16, 2013.

(51) Int. Cl.
*F23G 7/08* (2006.01)

(52) U.S. Cl.
CPC ..... *F23G 7/085* (2013.01); *F23D 2207/00* (2013.01); *F23D 2900/00014* (2013.01)

(58) Field of Classification Search
CPC ..... F23G 7/085; F23G 7/08; F23G 5/24
USPC ..... 431/5, 202, 253, 284; 110/203–217
See application file for complete search history.

(56) References Cited

U.S. PATENT DOCUMENTS 2,242,653 A † 5/1941 Zink
3,566,809 A † 3/1971 Carry
3,822,984 A 7/1974 Straitz
3,822,985 A 7/1974 Straitz
3,915,622 A † 10/1975 Desty
4,468,193 A 8/1984 Lawrence et al.
4,548,576 A * 10/1985 Chesters ..... F23G 7/085 431/202
4,741,691 A * 5/1988 Messimer ..... F23D 14/725 431/202
5,429,496 A * 7/1995 Stephens ..... F23G 7/085 431/202
6,146,131 A * 11/2000 Wiseman ..... F23C 5/02 431/154
6,840,761 B2 † 1/2005 Hong
(Continued)

FOREIGN PATENT DOCUMENTS

CA 1085709 9/1980
GB 798979 † 7/1958

*Primary Examiner* — Avinash Savani
*Assistant Examiner* — Vivek Shirsat
(74) *Attorney, Agent, or Firm* — Parlee McLaws LLP (CGY); Linda Thompson; Sean Goodwin

(57) ABSTRACT

A stack is provided for combustion of low pressure hydrocarbon vapors from various equipment, the combustion being discrete from periodic flaring of high pressure vapors from a top of the stack. A primary burner is positioned adjacent a base of the stack and a flare is positioned in the stack's bore adjacent a top thereof. Combustion air is naturally aspirated through the stack through inlets in the stack below the primary burners, providing both primary air and secondary air for the primary burners and first combustion air for the flare. The flare aspirates further combustion air from about the top of the stack. The combustion air optimizes clean burning at the primary burner and for reducing smoke production from the flare. A controller provides an auto re-light igniters at the primary burner and a continuous igniter at the flare.

25 Claims, 6 Drawing Sheets

(56) References Cited

U.S. PATENT DOCUMENTS

| | | | | |
|---|---|---|---|---|
| 7,566,218 | B2 * | 7/2009 | Aldrich | F23C 3/002 431/183 |
| 7,811,081 | B2 † | 10/2010 | Nigro | |
| D671,204 | S † | 11/2012 | Kovash | |
| 8,967,955 | B2 † | 3/2015 | Barthelet | |
| 8,967,995 | B1 | 3/2015 | Griffin et al. | |
| 2012/0015308 | A1 * | 1/2012 | Hong | F23G 5/50 431/5 |

* cited by examiner
† cited by third party

COMBUSTOR FOR DISCRETE LOW AND HIGH PRESSURE VAPOUR COMBUSTION

CROSS-REFERENCE TO RELATED APPLICATIONS

This application claims the benefit under 35 USC §119(e) of U.S. Provisional Patent application Ser. No. 61/834,841, filed Jun. 13, 2013 and U.S. Provisional Patent application Ser. No. 61/866,645, filed Aug. 16, 2013, the entirety of which are incorporated herein by reference.

FIELD

Embodiments disclosed herein relate to a combustor for destruction of combustible vapors from the vapor spaces of process tanks and for blow down of vessels, equipment, pipelines and the like during normal and emergency operations and, more particularly, for efficient combustion of low pressure vapors and accommodation of the flaring of high pressure vapor in a single stack.

BACKGROUND

Many tanks for storing liquids, particularly in the oil and gas industry, are associated with combustible vapors. Such tanks include, but are not limited to, oil production tanks, produced water and condensate tanks and the like. Hydrocarbon vapors collect in the head space of the tank. The tanks might be vented to atmosphere, but more preferably, for environmental and possibly regulatory reasons, the vapors need to be eliminated, such as through combustion in a flare.

Such tanks are usually operated at low pressures, such as just over atmospheric, the pressure therein numbering in mere inches of water column. Optional pumps or blowers can be used to raise scavenged vapors to higher pressure, such as to about 15 psig, for delivery and destruction in a vapor recovery unit such as an incinerator. Combustion of low vapor gases is typically a continuous process, in burners configured for low pressure fuel and air.

Further, it is known to blow down high pressure apparatus and flare the gases, either prior to equipment repair or for safety release of gas, such as in emergency situations. Apparatus which may require blow down include high pressure vessels, including but not limited to high pressure separator vessels, reboilers and the like. Blow down may also be required for high pressure gas transport lines. Such flaring is used to avoid unburned discharge of the high pressure vapors into the atmosphere. Typically, high pressure gas flaring is conducted using a simple open pipe discharge and igniter system, the gas stream being occasional, of short duration yet at high flow rates. Flaring produces significant radiant heat and are therefore elevated above the ground to space the source of heat from ground-based equipment and personnel.

Low pressure hydrocarbon gases having a molecular weight ratio to carbon of less than about 0.3 tend to produce smoke as a result of incomplete combustion and the formation of free carbon. Thus, where low pressure gases are to be combusted, either a smoke suppressant, such as steam or water, is known to be added or air is introduced to provide turbulent mixing with the hydrocarbon for minimizing smoke during combustion. High pressure hydrocarbon gases however are generally different as, upon release, there is sufficient kinetic energy to minimize smoke.

It is known to use separate flare combustors to handle each of low pressure and high pressure vapors however there is a high initial capital cost and ongoing maintenance costs associated with supporting separate stacks.

Others have attempted to provide single combustors which combust both low pressure vapors and high pressure vapors in the same stack. One such combustor is taught in Canadian Patent CA 1085709 to John Zink Company USA wherein a dual pressure burner is mounted at a top of a stack, the low and high pressure gases being supplied using separate lines extending through the stack to intermingled nozzles for simultaneous combustion at the same burner or burners. Air is aspirated by induction through the inside of the stack to low pressure gas discharge apertures. In another embodiment, a single relief line is used however this embodiment can only be used when the low and high pressure are not burned simultaneously. A blower is used to provide air to minimize smoke.

As taught in U.S. Pat. No. 3,822,985 to Straitz, low pressure gas is supplied through a conduit which extends within and to the top of the stack and high pressure gas is supplied through a separate conduit which extends along an outside and to the top of the stack, both low and high pressure gases being delivered for combustion at the top of the stack. A burner assembly at the top receives high pressure gas for combustion. Further low pressure gas is supplied through vanes, both low and high pressure gases being burned using the same burner assembly at the top of the stack.

Further, as taught in U.S. Pat. No. 3,822,984 to Straitz, the high pressure gas can be fed through a supply line extending inside the flare stack to a series of vanes at the top of the flare stack which provide a swirling action to the high pressure gas. The low pressure gas is fed through a separate supply line also extending inside the flare stack to a ring at a top of the stack. A series of continuously burning pilot burners ignite the low pressure gas. If high pressure gas is to be combusted it is supplied outwardly through the vanes and is ignited with the low pressure gas. If the flame begins to smoke, steam is provided through a plurality of steam nozzles surrounding the pilot burners.

Applicant believes that there is in risk in co-discharge of low and high pressure gases as pressure differential or backflow along the low pressure can trigger release valves in low pressure equipment resulting in a release. Further, such release valves, after exposure to the nature of high gas pressures, can remain stuck open even when the pressure returns to the normal low pressure, resulting in a continuing release of gas to the atmosphere.

Further, combustion efficiency is a concern. Current regulations for flaring of gas, whether it is low pressure or high pressure gas, require a minimum of 98% efficiency in Canada and a minimum of 95% efficiency in the USA. Along with being smokeless, the flame should not be visible at a top of the stack when combusting the low pressure gases. During emergency high pressure flaring situations, which are typically short in duration, flame is permitted to be visible above the top of the stack and the flame may produce smoke. It is desirable however that the amount of smoke be reduced or eliminated.

Clearly, there is interest in less costly, single flare apparatus which is capable of combusting both low and high pressure gas and which is able to meet or exceed the current stringent environmental and regulatory requirements and reduce or eliminate smoke production.

SUMMARY

Generally, a stack is provided for both an efficient combustion of low pressure hydrocarbon vapors while providing a separate and discrete high pressure vapor flare as required. A low pressure primary burner is positioned adjacent a base of the stack naturally aspirating combustion air through inlets below the primary burners. A flare is positioned in the stack's bore adjacent a top thereof. The flare is located in the bore of the stack and receives first combustion air aspirated from the stack itself and additional second combustion air from about the stack.

In one broad aspect, a combustor is provided for combustion of low pressure and high pressure hydrocarbon vapors. A substantially vertically extending stack has a cylindrical wall and a bore extending therethrough, a primary burner positioned in the bore adjacent a base of the stack, a primary pilot operatively connected to the primary burner for ignition of the primary burner; and low pressure vapor line operatively and fluidly connected to the primary burner for supplying the low pressure vapors thereto and forming a primary combustion zone thereabove. A flare is positioned in the bore adjacent a top of the stack and oriented upwardly. A flare igniter is adjacent the flare for ignition of the flare and a high pressure vapor line extends along the stack for entering the bore at a top of the stack for supplying the high pressure vapors thereto and forming a second combustion zone thereabove. One or more air openings extend through the wall of the stack below the primary burner for supplying combustion air to the primary burner and flare.

In other aspects, the low pressure burners can be naturally aspired, receiving primary combustion air for the primary burners and secondary combustion air mixing at a primary combustion zone in the stack above the primary burners. In another aspect, a portion of the secondary combustion air forming a first combustion air for the flare and the flare receives additional second combustion air from about the top of the stack.

In other aspects, an open end of the high pressure vapor line forms the flare and is located in the stack's bore at about the top of the stack for aspirating the portion of the secondary air.

In another aspect, the stack is provided with an ignition system including auto re-light pilot and igniter for the primary burner and a continuous igniter for the flare.

DETAILED DESCRIPTION

Figure 1:
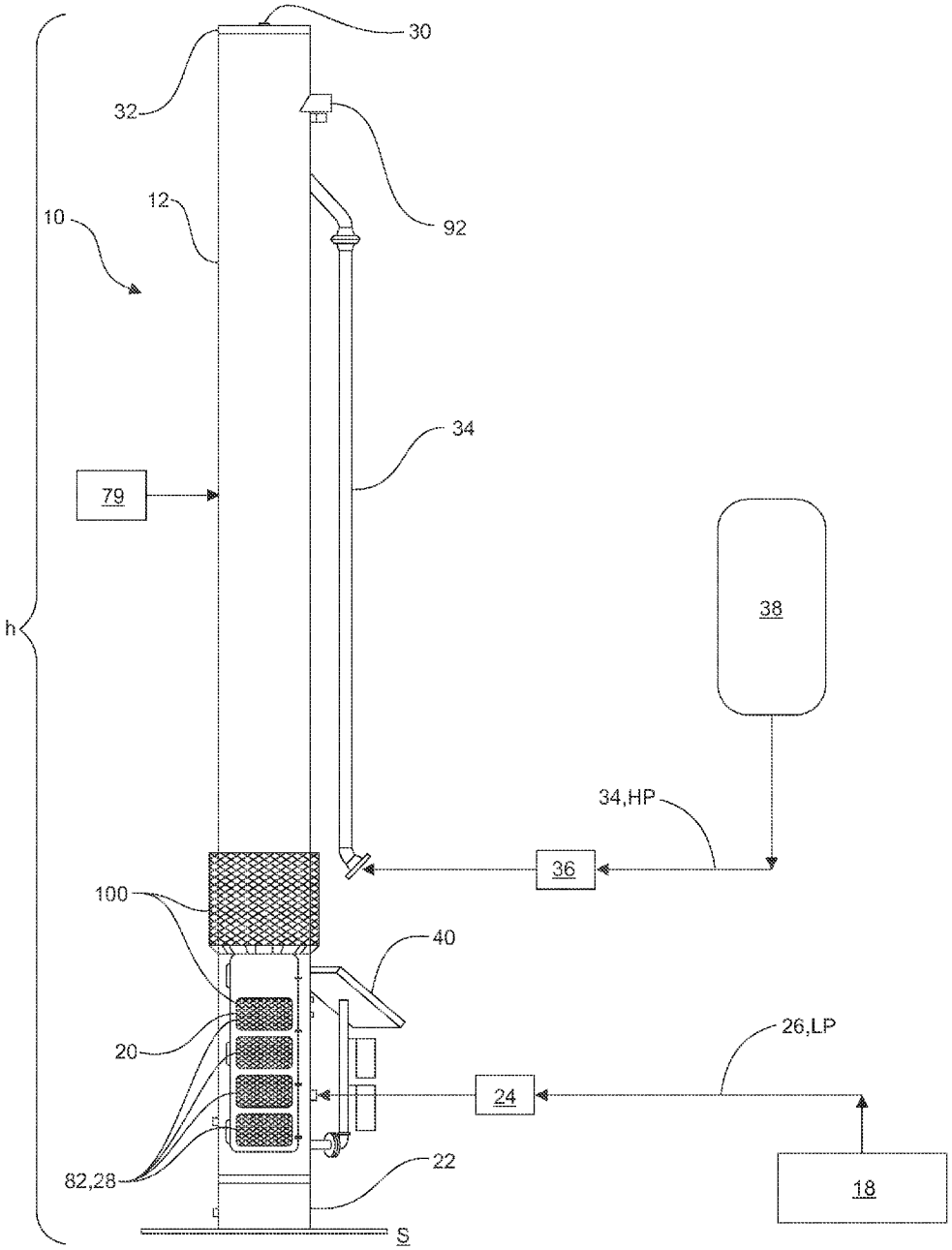
FIG. 1 is a schematic representation of a combustor according to a first one embodiment taught herein and having a single stack for combusting both low pressure vapors at a primary burner within the stack and high pressure vapors at a flare at a top of the stack.
Figure 2:
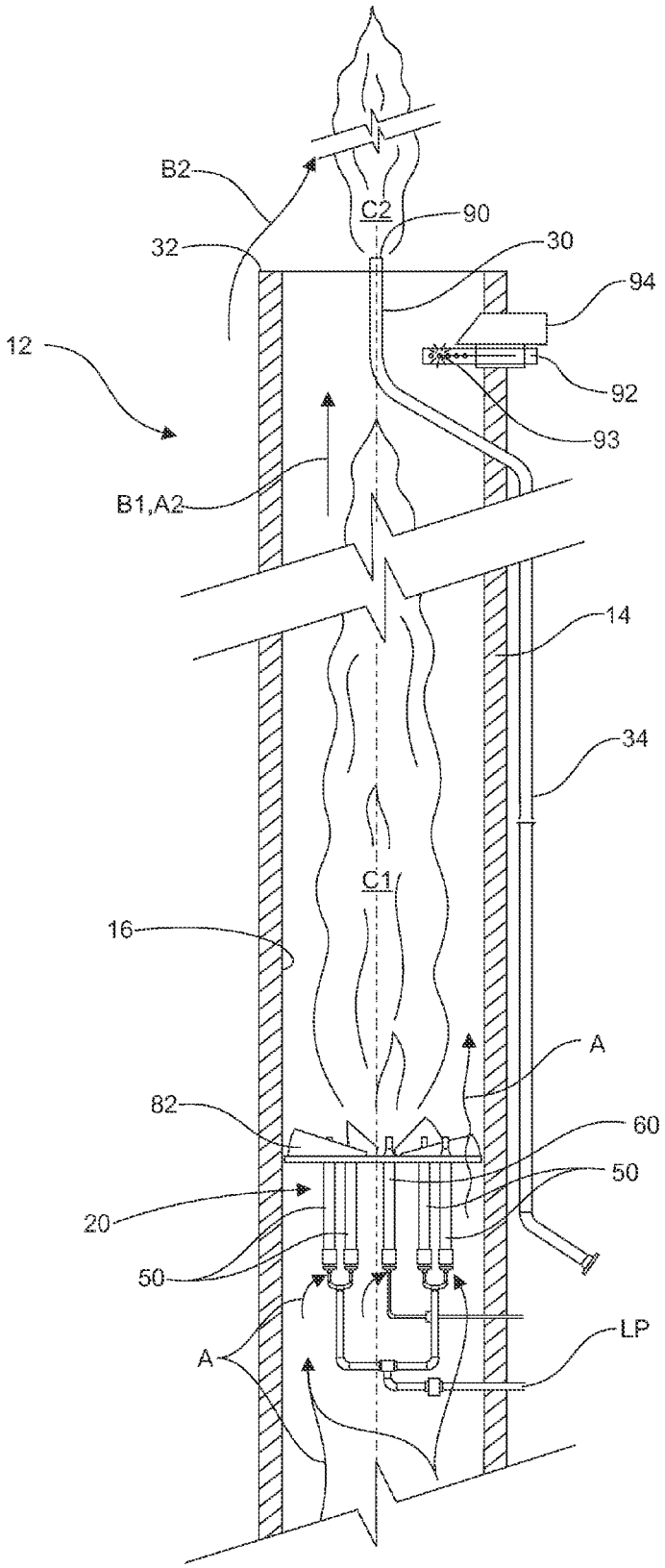
FIG. 2 is a partial cross-sectional view of the stack of FIG. 1, illustrating a high pressure vapor line external to the stack and entering through a wall adjacent the top of the stack.

As shown in FIGS. 1 and 2, a combustor 10 is provided for combusting low pressure vapors LP and flaring of high pressure vapors HP, either simultaneously or individually as required. Both operations are supported for operations by a single firetube or stack 12. The stack 12 extends vertically, having a cylindrical wall 14 and a bore 16 formed therealong. In embodiments, the stack 12 is stainless steel.

Periodic flaring of high pressure vapors HP is typically at larger flow rates than the usual and substantially continuous flaring of low pressure vapors LP. However, flaring is for shorter periods of time, such as for quick blow down of pipelines and vessels for repair or in emergency situations for release of excess gas. Incorporation of both a low pressure burner and a high pressure flare in a single flare stack 12 eliminates the need for a separate high pressure flare.

Low pressure vapors LP and high pressure vapors HP are provided using separate piping and combusted at discrete locations in the stack 12, enabling high efficiency combustion of the low pressure vapors and avoiding the risk of high pressure vapor HP backflow back to the low pressure vapor source. Embodiments taught herein result in complete combustion of the low pressure vapors LP within the stack 12. Further, the arrangement provided for combustion of the high pressure vapors HP adjacent a top of the stack 12 is generally more complete than for conventional flare stacks. A first flow of combustion air for the flare is provided through the stack 12 for optimizing a fuel to air combustion ratio for flaring, additional combustion air provided from about the stack.

Low pressure vapors LP are fed from a low pressure source 18, such as an oil storage tank, a hydrocarbon storage tank or a water or condensate tank, to a primary burner 20 positioned low in the bore 16, at a first elevation adjacent a base 22 of the stack 12. A flame arrester 24 can be positioned in a low pressure feed line or pipe 26 which feeds the low pressure vapors LP to the burner, intermediate the source 18 and the primary burner 20. One or more air inlets 28 are provided below the primary burner 20, such as being formed through the wall of the stack 12. The inlets 28 are fluidly connected to the bore 16 for delivery of air A to the primary burner 20. During operation, primary burner 20 inducts air A through the air inlets 28 to the bore 16 for mixing with the vapors LP. Combustion occurs in a primary combustion zone C1 within the bore of the stack 12, located above the primary burner 20. In an example of a low pressure primary burner 20, as set forth in U.S. Pat. No. 7,566,218, some of the primary air A is drawn into burner tubes mixed as primary combustion air and the balance of the air A joins the combustion above the burner 20. The primary combustion zone C1 optimizes a combustion ratio of vapors LP and air A therein to aid in maximizing combustion.

A flare 30 is positioned in the bore 16 at a top 32 of the stack 12 for combusting the high pressure vapors HP, such as those delivered periodically depressurizing of equipment and pipelines. The high pressure vapors HP burn above the flare in a second combustion zone C2 above the flare 30, the zone C2 extending above the stack's top 32. The high pressure vapors HP are supplied to the flare 30 through a high pressure line 34. A flame arrester 36 can be positioned intermediate a source 38 of the high pressure vapors HP, such as a high pressure separator, dehydrator or reboiler or high pressure pipeline, and the flare 30 at the top 32 of the stack 12. In an embodiment, the flare 30 is generally an open pipe directed upwardly for unrestricted discharge of high pressure vapors HP therefrom.

The stack 12 is supported on the ground S such as on a concrete pad or other suitable support and has a height h to position the flare 30 at a second elevation in the stack 12 above the ground S, so that radiant heat therefrom is within appropriate limits and relevant regulations. Advantageously, the height h of the stack 12 extends the effective height of the stack 12 and accommodated the combustion zone C1 of the primary burner 20, the combustion zone C1 being longer than that for conventional low pressure combustors, permitting increased flaring capability and efficiency. Thus, the primary burner 20 can fire harder and for a longer duration without visible flame exposure out of the top 32 of the stack 12, meeting regulatory requirements. Applicant has also found that, where the height h of the stack 12 is double that of a conventional low pressure flare stack, flaring capacity can be also substantially doubled. As one of skill appreciates, during emergency flaring of high pressure vapors HP, it is not a requirement that flame at the flare 30 be contained within the stack 12.

In embodiments, such as shown in FIGS. 1 to 2, and discussed in greater detail below, the high pressure line 34 extends along an exterior of the stack wall 14. The high pressure line 34 angles inwardly, such as using a 45° dogleg, to enter the bore 16 through the stack wall 14 below the top 32 of the stack 1. The line 34 is located about a middle of the bore 16 and angles upwardly for positioning an open end of the line 34 generally concentrically in the bore to form the discharge of the flare 30.

Figure 3:
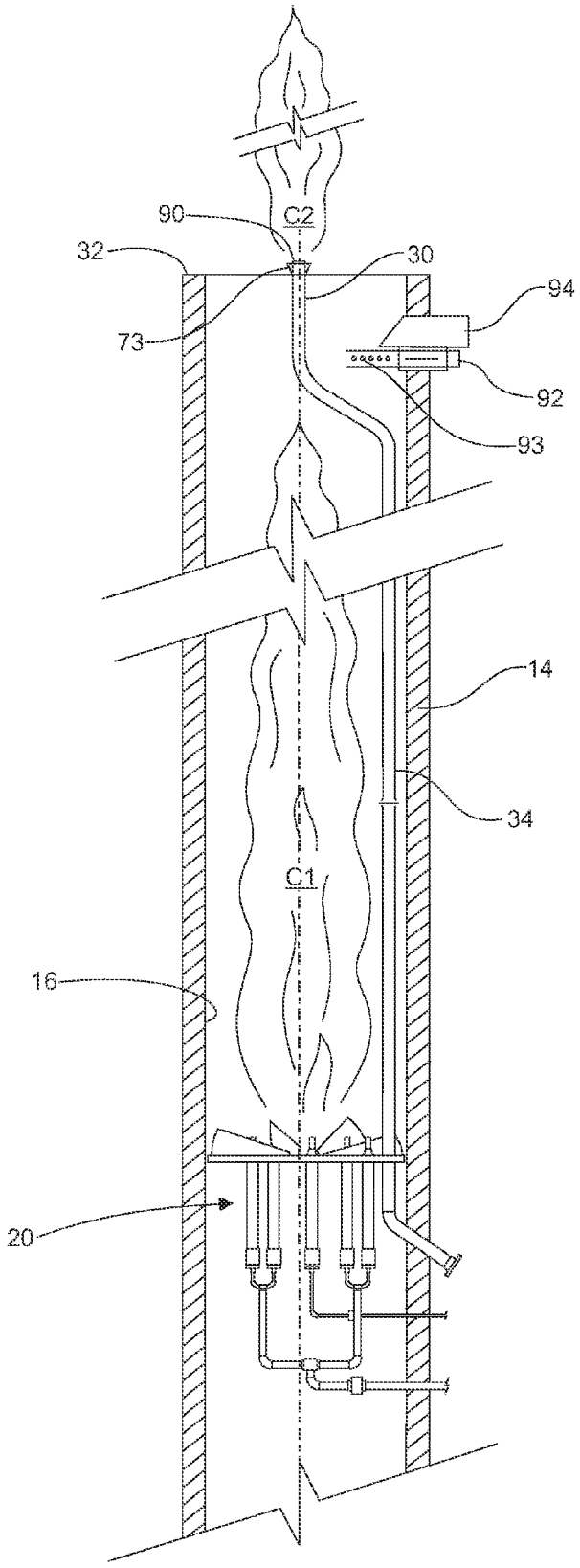
FIG. 3 is a partial cross-sectional view of the stack of FIG. 1, illustrating the high pressure vapor line extending along an interior of the stack.

In alternate embodiments, such as shown in FIG. 3, the high pressure line 34 enters the stack's bore 16 adjacent the base 22 and extends through the bore 16, along an interior of the stack wall 14. Again, adjacent the top 32, the line 34 angles inwardly to about a middle region of the bore 16 and then angles upwardly to the flare 30.

Advantageously, residual or excess air from the air A in the bore 16 also acts as secondary air A2 therein for both the primary burner 20, acting as a first combustion air B1 for the flare 30. Additional or second combustion air B2 is induced from about the top of the stack 12 to supplement the first combustion air B1, aiding in the combustion at the second combustion zone C2. The first and second combustion air B1,B2 reduces smoke despite the combustion occurring above the stack 12. In operation, the flare 30 further inducts air A through the air openings 28 in the stack 12 to add to the excess secondary air A2 for use as first combustion air B2. Thus, the combustor 10 is able to both meet or exceed the regulatory low pressure combustion limits, being 98% in Canada and 95% in the USA and perform emergency flaring which is not required to be smokeless under emergency conditions.

Figure 4:
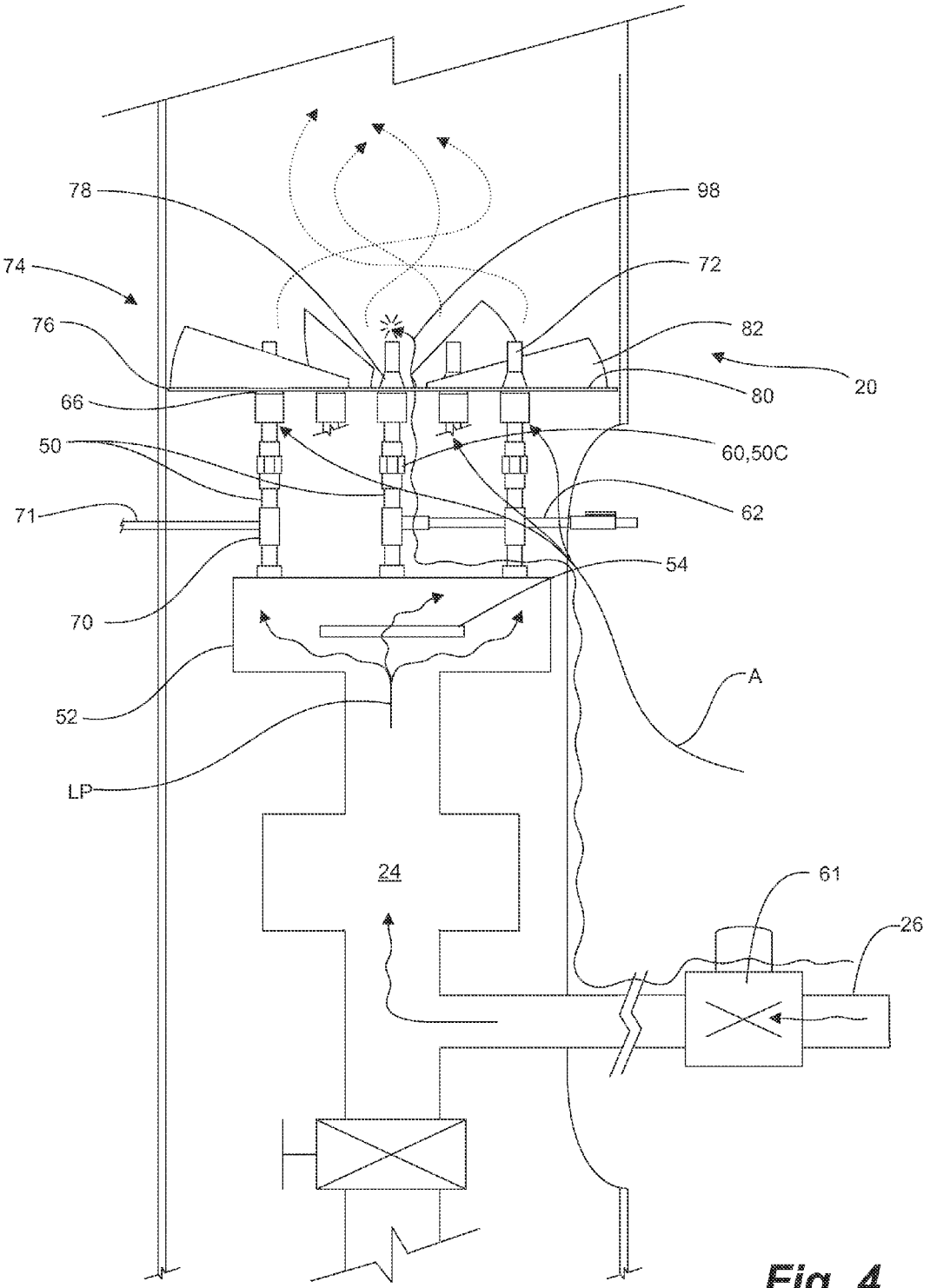
FIG. 4 is a side view of a primary burner according to an embodiment taught herein, the primary burner illustrating a plurality of burner assemblies, a primary pilot, a common supply header and a flame arrester.

Having reference to FIG. 4, and in an embodiment, the primary burner 20 comprises a plurality of burner assemblies 50 which are supplied with the low pressure vapors through a common supply header 52, fluidly connected therebelow. The header 52 receives the low pressure vapors LP from the low pressure line 26, such as through the flame arrester 24, and distributes the low pressure vapors LP to each of the plurality of burner assemblies 50. In an embodiment, the common supply header 52, in the form of a squat or low profile chamber, is fluidly connected to each of the plurality of burner assemblies 50. A flow barrier such as a deflector plate 54 positioned within the header 52 aids in distributing the incoming and upwardly flowing low pressure vapors LP, entering the common supply header 52 from below, laterally to the plurality of burner assemblies fluidly connected to the common supply header 52 thereabove.

Figure 5:
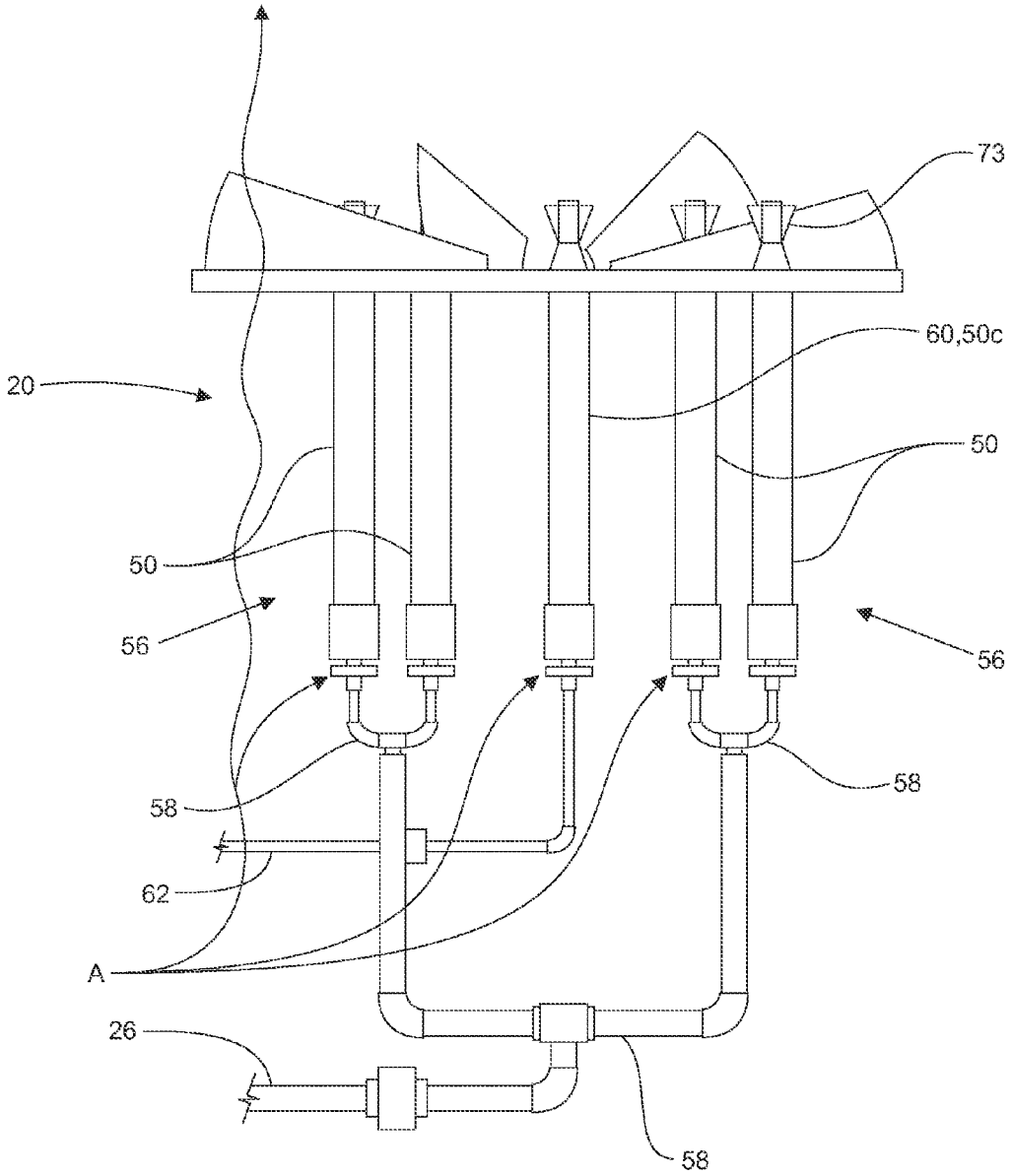
FIG. 5 is a side view of an alternate embodiment of the primary burner having T-fittings and piping forming a header for connecting directly between the low pressure feed line, the burner assemblies and the pilot.

In an alternate embodiment, as shown in FIG. 5, the primary burner 20 comprises a plurality of burner assemblies 50 which are directly fluidly connected to the low pressure vapor line 26, without a single common supply header 52. In the embodiment shown, there are four burner assemblies 50, each pair 56 of two of the four burner assemblies 50 being fluidly connected by T-connections 58 to the low pressure vapor line 26.

In embodiments of the primary burner 20, both with and without the common supply header 52, one of the burner assemblies is a pilot burner 60 which is supplied with pilot fuel gas from through a separate pilot fuel line 62. In embodiments, a center burner assembly 50*c* is designated as the pilot burner 60. In the case where there is a common supply header 52, the pilot burner may also be fluidly connected thereto and receive a portion of the low pressure vapors LP.

One suitable form of burner assembly 50, for the one or more burner assemblies 50 described herein, are those described in Canadian Patent 2,519,318 issued Feb. 5, 2013, Canadian Patent 2,694,415 issued Feb. 12, 2013, and U.S. Pat. No. 7,566,218, issued Jul. 28, 2009 all of which are owned by ACL Manufacturing Inc., the entirely of each being incorporated herein by reference.

Having reference again to FIG. 4, the plurality of burner assemblies 50 are natural draft burner assemblies particularly suitable for smokeless combustion of the low pressure vapors LP. The burner assemblies 50 provide combustion efficiency, low emissions and increased flame stability with excellent turndown ratios.

Each burner assembly 50 has a tubular barrel 64, the tubular barrel 64 having a distal end 66 and having a proximal end 68 for receiving low pressure vapor LP and primary combustion air. A mixing chamber 70, for combining the primary combustion air and fuel therein, is fluidly connected to the tubular barrel 64 for supplying the primary air A1 and low pressure vapor LP thereto. A fuel orifice (not shown) admits a flow of low pressure vapor LP therethrough to the mixing chamber 70. A plurality of air orifices (not shown) supply primary combustion air into the mixing chamber 70.

Alternatively, while the primary air A1 is usually naturally aspirated into each burner assembly 50, the mixing chamber 70 can also be additionally fit with an air assist 71, having a regulated air supply connected thereto. The air assist 71 can provide additional air directly into the mixing chamber 70. The air assist 71 can be used with vapors which require more air for complete combustion, such as heavy hydrocarbon vapors. For example, the air to fuel ratio might be maintained at about 15 to 1, air assist 71 being used to supplement any air deficiencies or desire for excess air.

A nozzle tip 72 is mounted in a burner head 74 at the distal end 66 of the tubular barrel 64 to which low pressure vapor LP fuel in the tubular barrel 64 and primary combustion air are directed. An air deflector plate 76 extends from an inner ring 78 at the tubular barrel 64. The air deflector plate 76 extends radially outwards into the bore 16 to intercept secondary combustion air A, flowing under natural draft therethrough. The air deflector plate 76 has a plurality of radially extending openings 80 formed therein, each opening 80 having an upstanding radially extending vane 82 formed therealong for deflecting the secondary combustion air circumferentially therefrom and into the primary combustion zone C1 at the nozzle tip 72 and in the bore 16 downstream therefrom.

As shown in FIG. 5, the burner assemblies 50 further comprise a low pressure ring 73 shaped such as an inverted, truncated frustum of a cone and is positioned circumferentially about the nozzle tip 72. A diameter of the low pressure ring 73 increases as it extends downstream and away from the nozzle tip 72 to prevent flame at the nozzle tip 72 from lifting therefrom as described in Canadian Patent 2,519,318, Canadian Patent 2,694,415 and U.S. Pat. No. 7,566,218 to ACL Manufacturing Inc.

Where insufficient secondary air A2 is available in the bore 16 to optimize the combustion ratio in the secondary combustion zone C2, a blower 79 can be fluidly connected to the bore 16 of the stack 12, above the primary burner 20, to provide additional secondary air A2 to the flare 30 thereabove.

A mixing chamber orifice (not shown) can be changed in accordance with the nature and heat capacity of the vapor. An onsite flow and gas analysis can be conducted to determine quantity and quality and will aid in selecting how many primary burner assemblies 50 are installed, or how many of a pre-set number of primary burner assemblies 50 are applied, the balance of un-needed burner assemblies 50 being shut in. The burner assemblies 50 can be operated at a relatively low temperature, low NOx with complete combustion. In embodiments, the burner conditions are determined based on achieving a 99% destruction of the vapor.

An ignition control system 40 controls ignition and flame sensing at the primary burner 20 and continuous ignition of the flare 30, as discussed in greater detail below.

In operation, the pilot burner 60 is initiated and when flame is confirmed, the low pressure feed line 26 is opened between the source 18 and the common supply header 52 or burner assemblies. As is typical with burner controls, the ignition can be turned off once flame is detected. Opening of the feed line 26 is accomplished using a manual or automatic valve 61, such as an automatic safety shutdown valve installed on the low pressure vapor feed line 26, which, in embodiments, is a 2" pipe.

As one of skill will appreciate the primary burner 20 can comprise any type of burner or burner assemblies suitable for combusting low pressure vapors LP.

Having reference to FIG. 2, in embodiments, the flare 30 comprises the high pressure flare pipe 34 which has a top open end 90. The open end 90 of the flare 30 is generally positioned at about the top 32 of the stack 12. The open top 90 can also be positioned at, slightly below or slightly above the top 32 of the stack 12. The flare 30 angles inwardly through the wall 14, if external to the stack 12, or from adjacent the interior of the wall 14, if internal to the stack 12, and then angles upwardly to position the open top 90 generally concentrically within the bore 16 of the stack 12.

In embodiments, the top 90 of the flare 30 is positioned from about 1" above the top 32 of the stack 12 to about 10" below the top of the stack 12. Applicant has applied this positioning in stacks having bore 16 of between 18" through 48" in diameter.

In embodiments, the flare pipe 30 is a 3" pipe. As one of skill will appreciate, as the secondary air A2 in the bore 16, forming first combustion air B1 to the flare 30, is only part of the air required for combustion. The flare 30 benefits from an additional amount of second combustion air B2 from outside the stack 12. Accordingly, the open top 90 of the flare 30 is positioned to balance the amounts of first and second combustion air B1,B2 and as a result should not located be too low in the stack 12, nor extend too high thereabove.

In embodiments, as shown in FIG. 3, the open top 90 of the flare 30 can also be fit with a low pressure ring 73 shaped such as an inverted, truncated frustum of a cone, positioned circumferentially about the open top 90. A diameter of the low pressure ring 73 increases as it extends upwardly, downstream and away from the top 90 of the flare 30. The ring can aid in for minimizing lifting of flame from the flare.

Due to the often difficult nature of the high pressure vapors causing fouling, the top 90 of the flare 30 does not typically comprise a nozzle to minimize cleaning and replacement. This does not preclude use of appropriate nozzles or maintenance schedules to accommodate same.

A flare igniter 94 is supported in the wall 14 of the stack 12 adjacent the open top 90 of the flare 30. The igniter 94 is controlled by the ignition control system 40 to provide continuous ignition for the flare 30 at all times regardless whether flame is detected. A side portion of the high pressure flare pipe 34, approaching the open end 90 and adjacent the igniter 94, can be purposefully compromised so as to spill a portion of the high pressure gas HP into the bore 16 adjacent the igniter 94 for assured ignition. In an embodiment, the flare pilot 92 is a perforated tube, permitting continuous entry of combustible vapors thereinto to ensure contact with the igniter and ignition when the flare 30 is in operation.

As noted above, in an embodiment the controller 40 is a dual controller responsible for at least ignition of both the primary pilot burner assembly 60 and the flare igniter 94. One suitable controller is the ACL 3200, CSC 200 or CSC 400, controller available from ACL Manufacturing Inc., of Sundre, Alberta, Canada. In embodiments, a thermocouple 96 is used to measure a temperature of a flame at the primary pilot 60 for flame sensing. If the temperature is below a setpoint, indicating that a flame is not present, an alarm is sounded and interlocked engaged. Upon initiation, a primary igniter 98 for the primary pilot 60 begins to spark at regular intervals until a flame is sensed and includes auto re-light operations. In embodiments, flame sensing is by flame rectification.

As one of skill will appreciate, any suitable dual controller 40 can be used. Alternatively, separate combustion controllers 40 can be used for ignition and control each of the primary burner 20 and the flare 30.

As low pressure vapors LP are combusted, temperature rises in the stack 12. The controller 40 can adjust a pilot fuel gas supplied through the pilot fuel gas line 62 to the primary pilot 60 or adjust the air assist 71 to the mixing chambers 70 of the primary burner assemblies 50 to control the air to fuel ratio and the resulting temperature. In instances where a minimum burn temperature is specified to ensure destruction, the pilot fuel gas may be supplied regularly and may be supplied all of the time. Otherwise, the low pressure vapor LP is burned passively as it arrives, the temperatures being self-regulating. Clearly, if the temperature in the primary combustion zone C1 becomes too hot, the fuel supply can be restricted.

Figure 6:
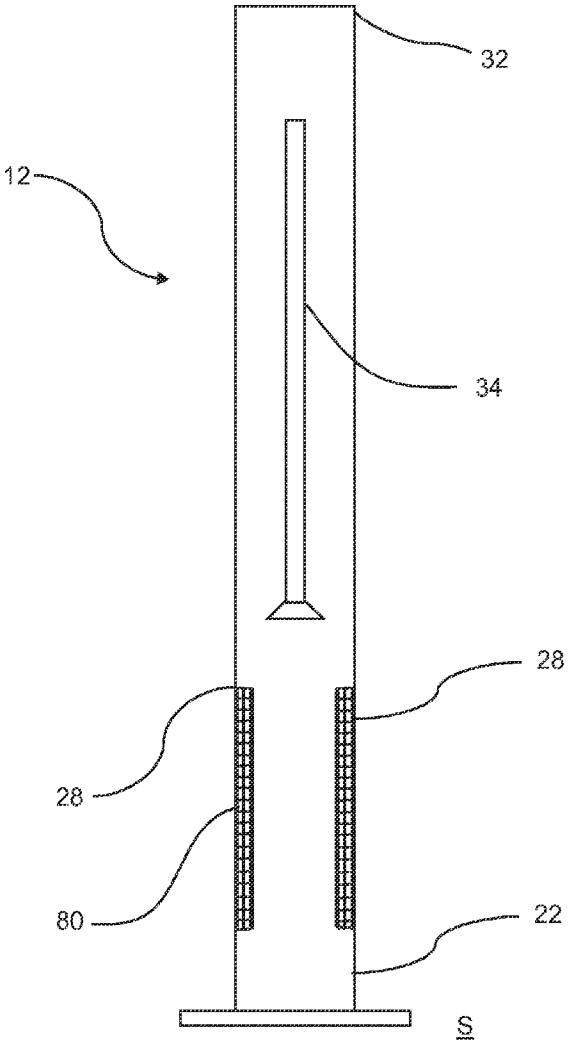
FIG. 6 is a fanciful side view of the stack of FIG. 1 having screened air openings on opposing sides of the stack.

In embodiments, as shown in FIGS. 1 and 6, the air openings 28 can be fit with safety screens 100 for a variety of purposes including limiting access, but also as flame containment. Should condensate be co-delivered with the low pressure vapor LP, the condensate can run back down from the nozzle tips 72 to the base 22 of the stack 12 and could ignite. Personnel safety is enhanced using screen flame containment.

Various configurations of air openings 28 are possible. Having reference to FIG. 6, two opposing air openings 28 are shown, both screened, one of which can also function as an access door 82. Alternatively, for example, as shown in FIG. 1, a plurality of air openings 28, four shown, can be located in the same tubular side wall of the stack 12 with no opposing air openings 28 on the other side. In all cases, the capacity of inlets 28 matches combustion air requirements, however site and equipment placement may provide access challenges dictating optional arrangements and locations for the inlets 28.

A further extension or additional safety screening 100 can be provided above the inlets 28, positioned circumferentially about a portion of the stack to prevent contact by personnel on the ground S, particularly at locations adjacent the primary burner 20.

As one of skill will appreciate, a height and diameter of the stack 12 can vary for varying capacity to combust low and high pressure vapors LP,HP. Examples of different sized combustors, according to embodiments taught herein, and the relative capacities and specifications are found in Table A below. Nominal primary burner operation pressures of up to about 15 psig, and the flare line operates at pressures of up to about 120 psig.

TABLE A

| Dimensions Diam. × Ht. | Max low pressure vol. (scfd) with pilot | Max high pressure vol. (scfd) with pilot | Total volume (scfd) | Destruction removal efficiency* |
|---|---|---|---|---|
| 24" × 26' | 25,500 | 1,700,000 | 1,725,500 | 99.9% |
| 36" × 26' | 45,000 | 1,700,000 | 1,745,000 | 99.9% |
| 48" × 26' | 75,000 | 1,700,000 | 1,775,000 | 99.9% |

*Meets EPA NSPS 40 CFR 60 Subpart 0000 in USA and AER directive 60 in Canada

In testing for certification under EPA NSPS 40 CFR 60 Subpart 0000 in the USA and AER directive 60 in Canada, propylene was used as the inlet fuel and as low pressure vapor for the primary burner which included six burner assemblies arranged about one pilot burner assembly for a total of seven burner assemblies. The burner tip velocity range was about 5.4 ft/sec at 1 scfm to 59.5 ft/sec at 11 scfm through the primary burner assemblies. Each of the seven burner orifices was 0.1160 inches. In operation, the exit temperature from the stack 12 was in the range of 511° F. to 1,391° F. (266° C. to 755° C.). Pilot flame sensing was performed using flame ionization through an ACL3200 controller. The pilot fuel used was provided at 2,750 scfd.

In a 24 inch diameter stack having a height of 26 feet according to an embodiment taught herein, hydrocarbon destruction for the lowe pressure gas LP was in excess of 99.9%. The outlet carbon monoxide concentration was less than 4.43 ppmv and the total outlet hydrocarbon concentration, measured as propane, was less than 0.52 ppmv. The outlet excess air was greater than 150 percent for four required test conditions. The maximum inlet fuel rate tested was 11 scfm (69.11 lb/hr) or 15,840 scfd plus the pilot gas rate of 1.9 scfm or 2,750 scfd which represented 90-100% of the maximum condition. Other tests were 70-100% (9 scfm or 57.41 lb/hr), 30-70% (5 scfm or 32.43 lb·hr) and 0-30% (1 scfm or 6.53 lb/hr). The maximum net heating value of the primary burner was 1.54 MMBTU excluding the pilot burner.

Embodiments in which an exclusive property or privilege is claimed are defined as follows:

1. A combustor for combustion of low pressure and high pressure hydrocarbon vapors comprising:

a substantially vertically extending stack having a single diameter, a cylindrical wall and an enclosed bore extending therethrough, the stack having a height sufficient to at least minimize radiant energy at a ground surface;

a primary burner positioned in the bore adjacent a base of the stack, a primary combustion zone being formed thereabove;

a primary pilot operatively connected to the primary burner for ignition of the primary burner;

a low pressure vapor line operatively and fluidly connected from a low pressure source to the primary burner for supplying low pressure vapors at a pressure up to 15 psi and at a first flow rate thereto;

a flare positioned in the bore adjacent a top of the stack and oriented upwardly for forming a secondary combustion zone thereabove, at least a portion of the secondary combustion zone extending above the stack;

a flare igniter adjacent the flare for ignition of the flare;

a high pressure vapor line extending along the stack for entering the bore at the top of the stack for periodically supplying high pressure vapors from a high pressure source to the flare at pressures greater than 15 psi and at a second flow rate at least 20 times greater than the first flow rate to the primary burner, for combusting in the second combustion zone thereabove;

one or more air openings extending through the wall of the stack adjacent the base of the stack and below the primary burner for supplying primary and secondary combustion air to the primary burner and primary combustion air to the flare, the primary and B secondary air being inducted through the air openings.

2. The combustor of claim 1 wherein the primary burner comprises a plurality of primary burner assemblies.

3. The combustor of claim 2 wherein each of the plurality of the primary burner assemblies are naturally aspirated.

4. The combustor of claim 1 wherein the flare receives secondary combustion air from about the top of the stack.

5. The combustor of claim 1 wherein an open end of the high pressure line forms the flare.

6. The combustor of claim 5 wherein the open end of the high pressure line is positioned generally concentrically in the bore of the stack at about the top of the stack.

7. The combustor of claim 2 wherein at least one of the plurality of primary burner assemblies is the primary pilot burner the apparatus further comprising a pilot fuel line for supplying a pilot fuel gas to the primary pilot.

8. The combustor of claim 7 wherein a center burner assembly of the plurality of primary burner assemblies is the primary pilot, the primary pilot being fluidly connected to the pilot fuel line.

9. The combustor of claim 2, the burner further comprising a common supply header fluidly connecting the plurality of primary burner assemblies for receiving and distributing the low pressure vapors thereto.

10. The combustor of claim 9 wherein the common supply header is a low profile, cylindrical chamber, the common supply header further comprising a flow barrier therein to intercept incoming upwardly vapor flow and distribute the vapor laterally to inlets to the plurality of primary burner assemblies.

11. The combustor of claim 9 wherein the pilot burner is fluidly connected to the common supply header for receiving at least a portion of the vapors therefrom.

12. The combustor of claim 3 wherein each of the plurality of burner assemblies comprises:

a tubular barrel, the tubular barrel having a distal end and having a proximal end for receiving low pressure vapor and primary combustion air;

a mixing chamber for combining the primary combustion air and low pressure vapor therein, the mixing chamber being fluidly connected to the tubular barrel for supplying the primary air and vapor mixture thereto;

a vapor orifice for admitting a flow of the low pressure vapor therethrough to the mixing chamber;

a plurality of air orifices through which primary combustion air is directed into the mixing chamber; and a nozzle tip mounted in a burner head at the distal end of the tubular barrel, low pressure vapor in the tubular barrel and primary combustion air being directed toward the nozzle tip.

13. The combustor of claim 12 wherein each of the plurality of primary burner assemblies further comprises:

an air deflector plate extending from an inner ring at the tubular barrel and extending radially outwards into the bore to intercept secondary combustion air flowing under natural draft therethrough, the air deflector plate having a plurality of radially extending openings formed therein, each opening having an upstanding radially extending vane formed therealong for deflecting the secondary combustion air circumferentially therefrom and into the primary combustion zone at the nozzle tip and in the bore extending downstream therefrom.

14. The combustor of claim 12 wherein each of the plurality of primary burner assemblies further comprises a low pressure ring positioned circumferentially about the nozzle tip for deflecting secondary air therefrom, the low pressure ring being shaped as an inverted, truncated frustum of a cone increasing in diameter downstream from the nozzle tip for minimizing lifting of flame therefrom.

15. The combustor of claim 12 wherein each of the plurality of primary burner assemblies further comprises an air assist for providing additional primary air to the mixing chamber for optimizing an air to vapor ratio therein.

16. The combustor of claim 1, wherein the low pressure vapor line enters the bore below the primary burner for supplying the low pressure vapor to the primary burner and the high pressure vapor line extends along an exterior of the stack for entering the bore through the cylindrical wall below the top of the stack for supplying the high pressure vapor to the flare.

17. The combustor of claim 1, wherein the low pressure vapor line enters the bore below the primary burner for supplying the low pressure vapor to the primary burner and the high pressure vapor line enters the bore below the primary burner and extends along an interior of the cylindrical wall to the top of the stack for forming the flare.

18. The combustor of claim 1 wherein the flare is positioned from 10" below the top of the stack to 1" above the top of the stack.

19. The combustor of claim 1 further comprising a controller for ignition of the primary pilot igniter when a flame is not sensed at the primary pilot.

20. The combustor of claim 1 further comprising a controller for continuous ignition of the flare igniter.

21. The combustor of claim 1 further comprising a blower fluidly connected with the bore of the stack above the primary burner for supplying additional secondary air through the bore for further optimizing the air to vapor ratio at the secondary combustion zone.

22. The combustor of claim 1 wherein the flare further comprises a low pressure ring positioned circumferentially about an open top of the flare for deflecting secondary air therefrom, the low pressure ring being shaped as an inverted, truncated frustum of a cone increasing in diameter downstream from the flare for minimizing lifting of flame therefrom.

23. The combustor of claim 1 wherein the primary burner comprises:

an air deflector plate extending outwards into the bore to intercept secondary combustion air flowing therethrough, the air deflector plate having a plurality of radially extending openings formed therein, each opening having an upstanding radially extending vane formed therealong for deflecting the secondary combustion air circumferentially therefrom and into the primary combustion zone and in the bore extending downstream therefrom.

24. The combustor of claim 1 further comprising a screen covering at least the one or more air openings extending through the wall of the stack.

25. The combustor of claim 1 further comprising a flame arrester operatively connected to the primary burner and the flare.

* * * * *